United States Patent [19]

Schuhmann, Jr.

[11] 4,095,960

[45] Jun. 20, 1978

[54] APPARATUS AND METHOD FOR THE GASIFICATION OF SOLID CARBONACEOUS MATERIAL

[76] Inventor: Reinhardt Schuhmann, Jr., 1206 Hayes St., West Lafayette, Ind. 47906

[21] Appl. No.: 739,846

[22] Filed: Nov. 9, 1976

[51] Int. Cl.[2] ..... C10J 3/46

[52] U.S. Cl. ..... 48/197 R; 48/202; 48/210; 48/DIG. 2

[58] Field of Search ..... 48/73, 76, 77, 63, 92, 48/62 R, 86 R, 210, 202, 206, 197 R, DIG. 2

[56] References Cited

U.S. PATENT DOCUMENTS

| | | | |
|---|---|---|---|
| 220,087 | 9/1879 | Paillard | 48/206 |
| 594,540 | 11/1897 | Kitson | 48/63 |
| 1,790,824 | 2/1931 | Loebell | 48/73 |
| 2,691,573 | 10/1954 | Mayland | 48/210 |
| 3,019,095 | 1/1962 | Prang et al. | 48/63 |
| 3,061,421 | 10/1962 | Landau et al. | 48/197 R |
| 3,904,386 | 9/1975 | Graboski et al. | 48/210 |

FOREIGN PATENT DOCUMENTS

| | | | |
|---|---|---|---|
| 392,498 | 5/1933 | United Kingdom | 48/76 |

*Primary Examiner*—S. Leon Bashore
*Assistant Examiner*—George C. Yeung
*Attorney, Agent, or Firm*—Hopgood, Calimafde, Kalil, Blaustein and Lieberman

[57] ABSTRACT

A process and apparatus are provided for converting particulate carbonaceous fuel, such as high-sulfur bituminous coal, into a combustible gas, the process comprising forming an ignited fluidized bed of said particulate carbonaceous fuel in a closed-bottom shaft furnace, the shaft furnace having a roof enclosure, directing a jet stream of oxygen downward into the bottom zone of said ignited fluidized bed of particulate fuel by means of an oxygen lance passing axially through said roof enclosure in sealing engagement therewith, the velocity of said oxygen stream into said bottom zone being sufficient to form a dynamic highly turbulent suspension of said particulate fuel and its particulate reaction products deflecting substantially radially outwardly and upwardly and then inwardly and downwardly in a toroidally circulating manner in the bottom zone of said fluidized bed, continuously removing effluent gases formed by the reaction of said oxygen with said fluidized bed, and maintaining said fluidized bed by continually feeding makeup fuel to said shaft furnace.

When the jet-fluidized bed is operated continuously below ash-fusion temperatures, said bed will accumulate and maintain a high percentage of particulate ash which is continuously withdrawn from the furnace.

When the jet-fluidized bed is operated above ash-fusion temperatures and fluxes and sulfur fixation agents are fed with the coal, a molten bath is formed on the bottom of the furnace, said bath serving to collect ash, sulfides, iron, and other coal impurities in molten products which flow out of the furnace through tap holes.

16 Claims, 4 Drawing Figures

APPARATUS AND METHOD FOR THE GASIFICATION OF SOLID CARBONACEOUS MATERIAL

This invention relates to the gasification of solid carbonaceous material and to an apparatus therefor and, in particular, to the gasification of sulfur-containing coal, wherein the sulfur is substantially removed in the combined form as an iron sulfide reaction product and inhibited from entering the gas generated from the coal.

STATE OF THE ART

It is known to gasify coal or other solid carbonaceous material to produce low-BTU and medium-BTU gases which are either burned directly or converted into high grade fuel products. However, coal was deposed as a principal energy source following World War II and was replaced by low-sulfur natural gas and fuel oil. Owing to the impending fuel shortage, particularly with regard to the so-called "clean" fuels, coal is once again being given favorable consideration as a major energy source. However, the restrictions placed by the Environmental Protective Agency on the use of "dirty" fuels, e.g. sulfur-containing coal, continue to impede its general use as a source of energy.

The major thrust of current coal gasification research is in on-going joint government-industry projects. Many of these projects are directed to the use of fluidized beds, such as those commonly employed in large scale chemical and metallurgical processes involving reactions of gases with particulate solids.

In the conventional fluidized bed reactor, the bed of particulate solids is maintained in a gentle fluidized state within a cylindrical vessel by an upward flow of the fluidizing gas distributed as uniformly as possible over the cross section of the reactor vessel, the fluidizing gas being introduced from below the bed through a horizontal grid or grate, which is also adapted in some measure to support the bed if the gas flow is interrupted.

As the upward flow of gas is increased above the minimum required for fluidization, certain phenomena are encountered. For example, with many particulate materials, smooth fluidization and the formation of a relatively homogeneous gently turbulent fluid-like bed occur at velocities not far above the minimum fluidization velocity. However, as the velocity is further increased, bubble formation becomes prominent and aggregative fluidization occurs. Bubble coalescence and associated phenomena reduce the efficiency and intimacy of gas-solid contact and make it difficult to achieve uniform behavior over the entire area of a large bed. Still higher velocities, approaching the free settling velocities of the particles in the bed, result in entrainment of substantial fractions of the solids in the gas stream leaving the top of the reactor. At such velocities, a fast fluidized bed can be maintained by using a cyclone separator to recover entrained solids from the effluent gas stream and continually returning the recovered solids to the bottom of the fast fluidized bed.

Although conventional fluidized bed reactors have proven to be highly effective and economical for many purposes, they have a number of limitations which restrict their applicability. The degree of turbulence and the intensity of agitation are determined to a considerable degree by upward gas velocity, which must be kept low enough to avoid excessive entrainment. The design, operation, and maintenance of the gas distributor pose serious and critical engineering problems. In addition, operating temperatures must be kept low enough to avoid excessive agglomeration and incipient melting. Moreover, the bottom design of the usual reactor (grid or other type of foraminous grate) does not function to accumulate and hold the molten product that may form from ash or other materials in the coal being gasified. Thus, the conventional fluidized bed reactors have not been adaptable to the use of reactants in which molten products are formed, such as slags, mattes, and the like. Therefore, the conventional fluidized bed reactors are generally limited to temperatures below the ash-melting temperatures of the coal being gasified. As a further consequence of major practical importance, conventional fluidized-bed reactors must be operated at relatively low temperatures at which the $H_2O$-C and $CO_2$-C gasification reactions proceed rather slowly.

A process proposed for gasifying high-sulfur coal is disclosed in U.S. Pat. No. 3,625,164 (issued on Dec. 7, 1971). According to this patent, a fluidized bed of coal and limestone is formed in a reactor to recover heating values therefrom, the reactor including a gasification zone, combustion zone and a heat recovery zone. The bed is supported on a moving foraminous grate. A primary flow of air is employed passing through the grate to fluidize the bed of coal. Under reducing conditions, sulfur in the coal reacts with the limestone to form CaS and an effluent gas rich in CO. The CaS is discharged from the gasification zone with the ash by the moving grate. The gaseous effluent, containing entrained desulfurized coal fines, enters the combustion zone where it is burned with secondary air. A disadvantage of this process is that the mixture of CaS and ash is difficult to handle and is hygroscopic in humid atmospheres and hydrolyzes to CaO and $H_2S$, the $H_2S$ becoming a pollutant. Also, regeneration of CaO and recovery of S in saleable or disposable form are difficult and costly.

Another process is that proposed in the recently issued U.S. Pat. No. 3,840,353 (issued Oct. 8, 1974). In this process, granulated coal or coke in sizes up to about three-fourths of an inch is fed into a slow stationary fluidized bed maintained at about 1900° to 2100° F and supplied with a gasification medium, such as oxygen and steam. The whole bed is segregated into a two-bed system comprising a contiguous fast bed of fines fluidized by gases rising from a lower fluidized slow bed of larger particles. Both beds operate at superficial fluidizing-gas velocities greater than about 4 feet per second. The gasification products and coal or coke fines are withdrawn from the fast bed and the solids separated from the gases in a cyclone separator, the gasification products being discharged, the separated fines being then recycled to the fast bed at a rate sufficient to maintain the fast fluidized state therein. As the coal or coke is gasified, agglomerated particulate ash forms in the slow bed and is withdrawn from the bottom of the bed. Thus, this process is critically dependent on control of temperature and other process variables to achieve formation of ash agglomerates which can be removed by a rotating grate or melted and discharged through a complex "slagging grate." A further disadvantage of this process is that any sulfur in the coal enters the gasified product. For example, a bituminous coal treated by the process comprising by weight 69.7% C, 5.3% $H_2$, 3.8% S, 9.9% $O_2$, 1.3% $N_2$ and 10% ash resulted in an effluent gas containing in terms of mole percent 55.2% CO, 32.1% $H_2$, 4.3% $CH_4$, 2.8% $CO_2$, 3.4% $H_2O$, 1.3% $H_2S$, 0.7% $N_2$ and 0.2% A. As will be noted, the sulfur enters the gas as $H_2S$ and thus must be subsequently removed to meet anti-pollution standards.

My invention differs from the foregoing prior art in that it provides a highly turbulent, rapidly circulating fluidized bed characterized by intimate gas-solid contact and high reaction intensity and in that said fluidized bed is supported above a solid furnace bottom or, if desired, above a molten bath. My invention has particular use in the gasification of high-sulfur coal, although it is not necessarily limited to such coals as will be apparent hereinafter.

OBJECTS OF THE INVENTION

It is thus an object of my invention to provide an improved process for gasifying solid carbonaceous material (e.g. coal, coke and the like) and produce a gaseous effluent rich in combustibles.

Another object of my invention is to provide an improved process for gasifying high sulfur solid carbonaceous material and produce a combustible gaseous effluent in which the amount of sulfur has been substantially decreased.

A further object of my invention is to provide a process for gasification of solid carbonaceous material in a fluidized bed at temperatures above the fusion temperatures of the ash.

A still further object of my invention is to provide an apparatus for gasifying solid carbonaceous material, including all types of coal.

These and other objects will more clearly appear when taken in conjunction with the following disclosure and the accompanying drawings, wherein.

STATEMENT OF THE INVENTION

Figure 1:
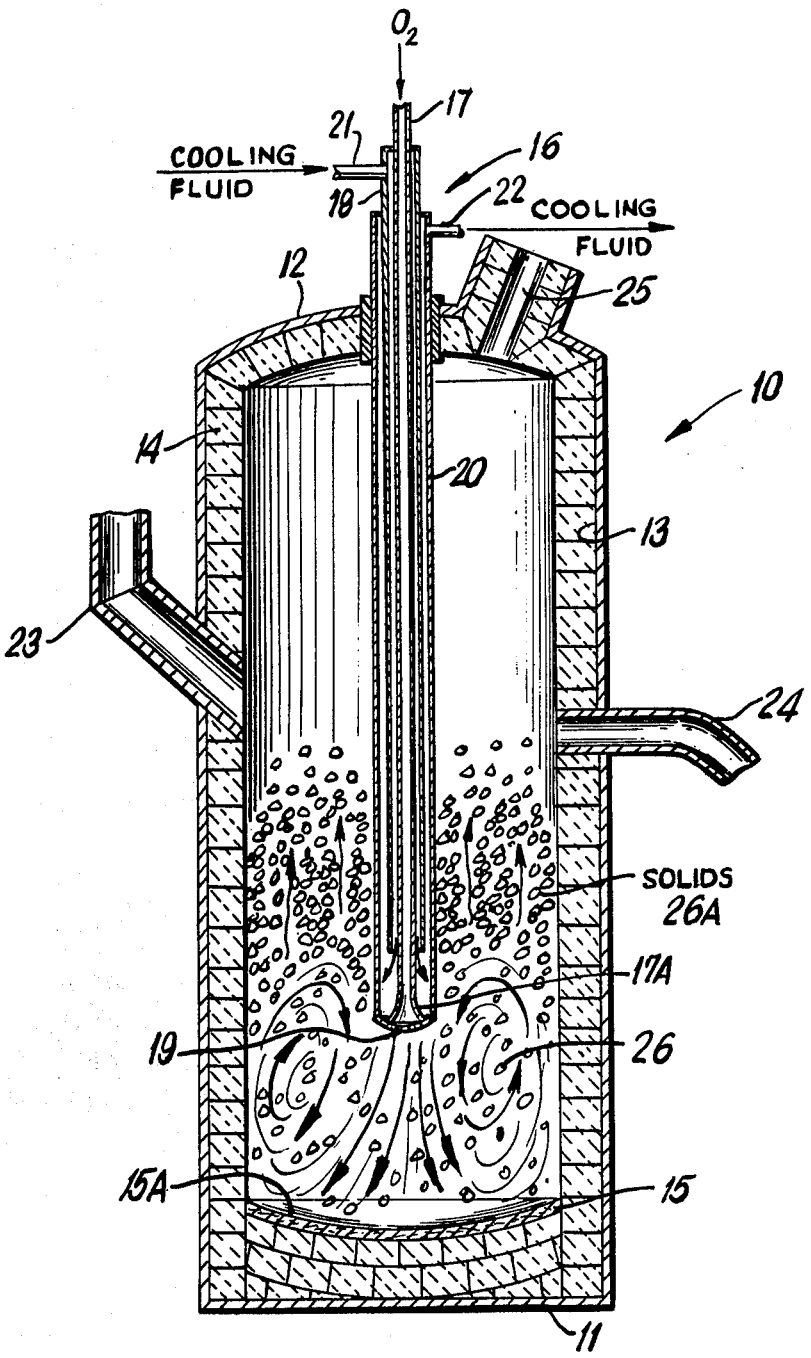
FIG. 1 is a vertical view in cross section of one embodiment of a reactor for use in producing a jet-fluidized bed of particulate carbonaceous material for conversion into gas in accordance with the invention.

In its broad aspect, one embodiment of the invention is directed to a method for converting particulate carbonaceous fuel to a combustible gas comprising, forming a bed of particulate carbonaceous solids in a closed-bottom shaft furnace or reactor at a temperature of at least about 1600° F, said reactor having a roof enclosure, directing a jet stream of oxygen-rich gas into said fluidized bed of particulate fuel by means of an oxygen lance passing axially through said roof enclosure substantially in sealing engagement therewith, the velocity of the oxygen stream into the bottom-supported bed being sufficient to form in the zone of said fluidized bed below the lance a dynamic highly turbulent suspension of said particulate carbonaceous fuel deflecting substantially radially outwardly and upwardly on the outside and then inwardly and downwardly in the region of the nozzle end of said lance in a toroidally circulating manner just above the bottom of said shaft furnace, said dynamic circulating suspension defining a zone of rapid reaction to the bottom of the furnace, continuously removing gases formed by the reaction of said oxygen-rich gas with said bed, and maintaining said dynamic swirling suspension by continually feeding particulate make-up fuel to the bottom of said shaft furnace to provide a reactor temperature ranging from about 1800° F to 2700° F.

The dynamic swirling suspension of the bed provides certain beneficial effects to be described later, the suspension being configured as stated above so as to deflect radially outwardly and upwardly from the bottom and them inwardly and downwardly under the lance, such as to define a substantially toroidal shape. The total feed rates of oxygen-rich gas and the carbonaceous solids are maintained to provide an average upward velocity of effluent gas substantially above the minimum fluidization velocity for said carbonaceous solids.

Another embodiment of the invention is directed to a jet-fluidized reactor and system for use in converting a particulate carbonaceous fuel into a combustible gas, the reactor comprising a vertically disposed shaft furnace or reactor having a closed-end defining the bottom thereof and a roof enclosure, the bottom being adapted to support thereon a bed of particulate carbonaceous material. A fluid-cooled oxygen lance is provided passing axially through the roof enclosure thereof in sealing engagement therewith, with its orifice end disposed above the bottom of said furnace, the lance being adapted to direct a stream of oxygen into a hot bed of particulate carbonaceous fuel, e.g. coal, coke and the like, supported by the bottom of said furnace. Provision is made for a first port means in a wall of said furnace through which particulate carbonaceous fuel is continually fed to the bottom of said furnace, a second port means being provided at substantially the top of this furnace for removing product combustible gas formed by the reaction of said oxygen with said carbonaceous fuel.

The foregoing embodiments of the invention are particularly useful in the treatment of high-sulfur coal although low-sulfur coal with a relatively high ash content can also be treated. The world's largest coal resources are within the United States. In 1972, the United States Department of the Interior had estimated that about 3.2 trillion tons of coal lie beneath the surface of 37 states. Much of the coal is bituminous and has a relatively high sulfur content. Midcontinent coals average well over 2% S, and some coals in Indiana and Iowa contain as much as 6% S.

I find that my invention is particularly applicable to high-sulfur coal as I can employ a preferred embodiment to inhibit the sulfur from entering the product gas formed in my process by fixing the sulfur as iron sulfide which can be easily removed from the reaction zone.

Figure 2:
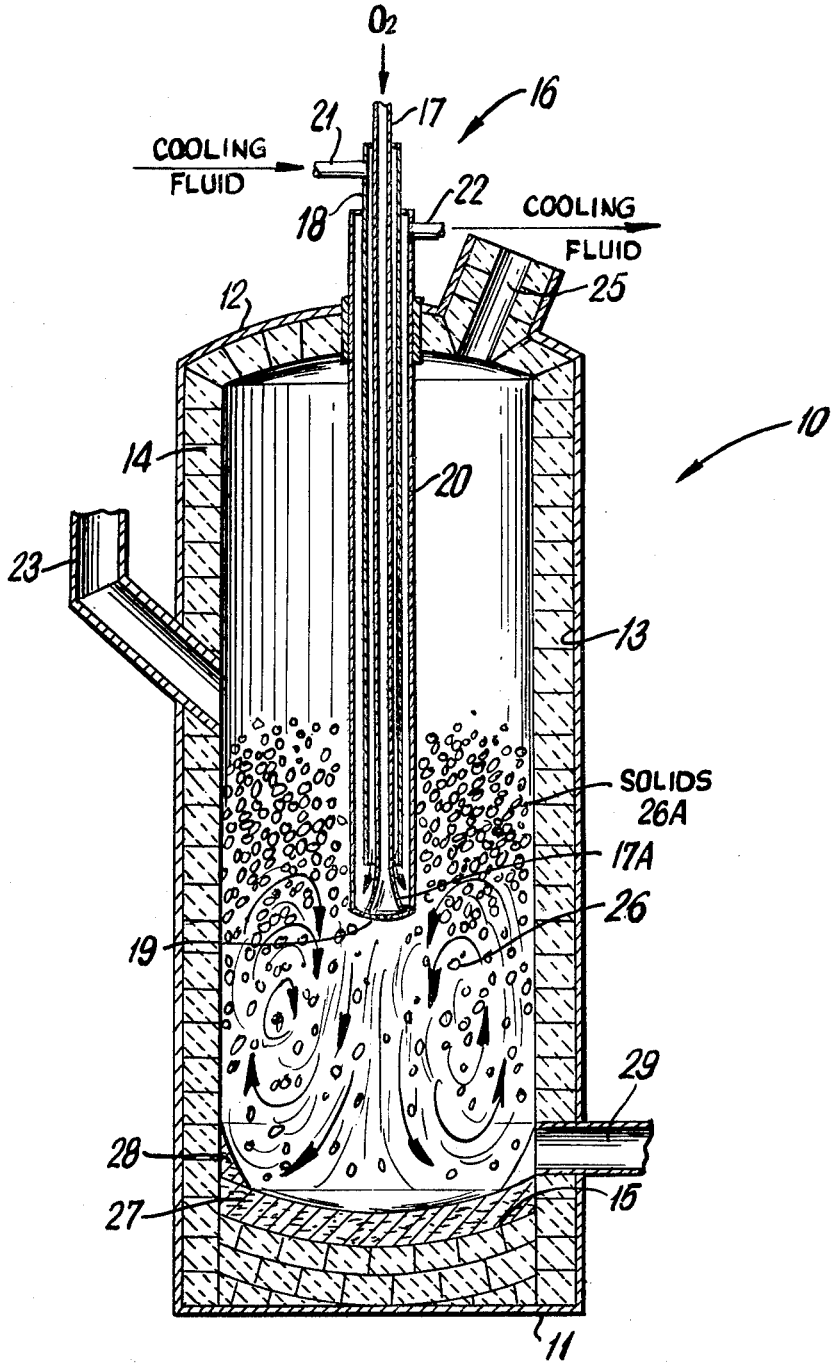
FIG. 2 is a vertical cross section of a reactor similar to FIG. 1 showing molten phases formed during the jet-fluidized treatment of carbonaceous material, e.g. coal, in accordance with the invention.

Before discussing the detailed process aspects of my invention, it would be helpful at this point to describe the apparatus embodiments illustrated by FIGS. 1 and 2.

Referring to FIG. 1, a jet-fluidized reactor vessel of preferably cylindrical shape is shown in the form of a vertically disposed shaft furnace 10 having a closed bottom 11 and a roof enclosure 12 as shown at the top thereof. The shaft furnace is provided with a steel shell 13 with an inner refractory wall 14 (furnace brick) lining the shell, the closed bottom of the furnace having several layers 15 of furnace brick as shown.

Extending axially into the furnace is an oxygen lance 16 comprising an inner oxygen-feeding tube 17 for receiving oxygen (or oxygen plus steam) passing through a concentric tube 18 of larger diameter, the inner tube 16 flaring outward as shown at 17*a* and terminating into a plural orifice nozzle 19 with an outer concentric tube 20, concentric tube 18 terminating short of the flare (17*a*) and defining a longitudinal annular chamber with outer tube 20 for receiving cooling fluid, e.g. water, to cool the oxygen lance.

Tube 18 has a fluid inlet port 21 through which cooling fluid is fed, while outer tube 20 has an outlet port 22 through which the cooling fluid exits. The manner in which cooling is effected will be obvious from the drawing. The end of outer tube 20 has a plurality of orifices, e.g. three, which are radially disposed at preferably 120° intervals about the longitudinal axis of the lance, the flared portion 17*a* of inner oxygen tube 17 being connected to the nozzle end of outer tube 20 and sealed from the annular cooling chamber surrounding the oxygen tube.

Coal feeding port 23 is provided entering a side wall of the furnace through which particulate coal is fed continually into the furnace to form a bed thereof at the bottom of the furnace.

An outlet or overflow port 24 is also provided on the wall portion opposite the coal port through which solid reaction products, e.g. ash, iron sulfide, etc., may be discharged. However, in accordance with prior fluidization practice, some or all of the solid products may be carried out with the effluent gas through gas outlet 25 to a cyclone separator, and part of the cyclone overflow may be returned to the reactor to maintain a high concentration of solids in the reactor and to increase the average residence time of the solids.

Thus, the jet-fluidized reactor of the invention is designed to operate over approximately the same ranges of total gas flow rates per unit of cross sectional area as the conventional fluidized furnaces and, moreover, can be designed to operate at elevated pressures. Under some conditions, elevated pressure may provide greater throughput and/or thermodynamic and kinetic conditions more favorable than those at atmospheric pressure.

The essential difference between the conventional fluidization furnace and the jet-fluidized concept of the invention resides in the method of introducing the fluidizing and reacting gas. In the conventional fluid bed apparatus, a fluid bed supension is gently maintained over a grate or grid by an upward flow of gas at uniform velocity through the grid to provide uniform fluidization over the entire cross section of the reactor.

The present invention differs substantially in that an oxygen lance 16 is employed for establishing a highly turbulent fluidized bed 26 in the reaction zone of the furnace or reactor. Oxygen under relatively high pressure is fed through inner tube 17 to discharge as a high velocity stream through a preferably multi-orifice nozzle 19, although one orifice may suffice and impinge directly downward into a bed of particulate coal or other particulate carbonaceous fuel and transform it into a dynamic swirling suspension deflecting radially outwardly from the axis of said oxygen stream and upwardly adjacent to the walls of the furnace and then inwardly and downwardly in the region of the nozzle in a circulating manner just above the bottom of said furnace, the suspension having a kind of toroidal shape. Relative to conventional fluidized beds, this suspension exhibits much higher fluid and particle velocities, greater turbulence and more intensive mixing. Between the levels of the nozzle discharge (19) and the solids outlet (24), the degree of turbulence and the fluid dynamics of the fluidized suspension 26A are comparable with conventional fluidization.

The principles of flow through nozzles are described in many textbooks and need not be described here. Those skilled in the art have considerable practical knowledge with regard to the behavior of oxygen jets in large-scale furnaces, such knowledge having been available in the field of basic oxygen steelmaking for some years. In this connection, attention is directed to the article by G. C. Smith entitled "Multiple Jet Oxygen Lances-Theoretical Analysis and Correlation with Practice" in the Journal of Metals of July, 1966, said article being incorporated herein by reference.

A preferred multi-orifice design which is especially suitable for a jet-fluidized reactor having a cylindrical shape comprises three convergent-divergent orifices with each orifice axis forming an angle of about 10°–15° with the axis of the lance, and with the three jet axes projecting into the bottom of the reactor at 120° intervals, or other even spacing. When such a nozzle is operated with input pressure sufficiently high, each opening delivers a jet of gas with supersonic velocity at the orifices or nozzle openings, and this high velocity jet forms a cone having its apex in the nozzle and having a height to diameter ratio of about 2.8/1. The height to diameter ratio may range from about 2.5 to 1 to 3 to 1. If the three-jet nozzle is positioned above the reactor bottom in FIG. 1, a distance equal to about 1.3 times the inside diameter of the reactor, the jets will impact over a large percentage of the bottom area, and the particulate solids will form a highly turubulent, well agitated, fluidized bed. If the lance is lowered, the impact of the jets covers a smaller area of the bottom, but the impact pressure on the bottom or on molten phases resting on the bottom is increased. Variations in the position of the lance also cause variations in the pattern of circulation of the fluidized bed. If the lance is raised too high or lowered too near the bottom, fluidization may become erratic and a large portion of the solids will then settle out on the bottom.

Further control of the dynamic conditions in the jet-fluidized bed to meet the requirements of efficient coal gasification is achieved by varying diameters of the individual orifices of the nozzles, gas pressure supplied to the lance, flow rates, and depth of the fluid bed. The preferred conditions are easily determined by tests. However, in making such adjustments, the total upward flow rate of product gas in the reactor space above the level of the nozzle should be sufficient to maintain an average upward gas velocity substantially greater than the minimum fluidization velocity as commonly understood but not so great as to cause excessive entrainment of solids in the gas stream leaving the top of the reactor. Thus, fluidization conditions above the nozzle (note upper bed of solids 26A in FIG. 1) are more closely akin to those in conventional fluidization; whereas, below the nozzle, the local fluid velocities, circulation rates and degree of turbulence are much higher than in conventional fluidization.

The bottom interior surface 15 of the jet-fluidized reactor shown in FIG. 1 is, of course, subject to very severe working conditions involving both chemical and mechanical erosion. Thus, the bottom should be lined with a cheap, easily renewable material chemically compatible with the gasification process in the reactor. One alternative is to spread crushed slag periodically and sinter it in place as shown by numeral 15A.

A basic disadvantage of the conventional fluidized bed is that its efficiency of operation can be adversely affected if melting occurs. It behaves unsatisfactorily under conditions of incipient melting or, in instances where the solids become sticky and thus agglomerate. The jet-fluidized reactor illustrated in FIG. 1 can handle material with a strong agglomerating tendency because the violent agitation as well as the impacting of particles on the bottom of the vessel causes the agglomerates to break up quite effectively.

The further advantages of the jet-fluidization process provided by the invention are best shown by reference to the reactor shown in FIG. 2 in which similar parts are designated by the same numerals. In this reactor, a highly turbulent jet-fluidized bed of particulate solids 26 is maintained above a molten bath made up of a lower layer of heavy iron-containing phase 27 and a partial layer of liquid slag 28, with a conventional type fluidized bed of solids 26A maintained above the jet nozzle. The continuous process depicted in FIG. 2 thus involves feeding a mixture of solid materials at 23 and feeding oxygen at 17 to yield a fuel gas at 25 and liquid products which accumulate at hearth or bottom 15 which are withdrawn through a port or taphole 29. To establish a fluidized bed over molen phases, the bed itself must contain a high proportion of solids which are relatively infusible, of lower specific gravity than the underlying liquids. These requirements are adequately fulfilled by fluidized beds containing large proportions of coal, coke or char (i.e. particulate carbonaceous fuel). Thus, the principal applications of jet-fluidization in the presence of molten phases in accordance with the invention are to processes in which coal, coke or char is a major reactant and $O_2$ is the major gas input with or without steam.

In the process illustrated in FIG. 2, the dynamic conditions at the liquid surface under the impact of the jet are similar to those in basic oxygen steelmaking, but with the added effects of the impacting solid particles. At liquid metal temperatures, reaction rates in this region are extraordinarily high. For example, in a pilot reactor charged with a mixture of minus 14-mesh coal (U.S. Standard mesh), iron ore and limestone and blown with a downward jet of pure oxygen, the by-products produced included an effluent gas comprised largely of CO and a molten phase comprising iron containing 4.08 percent carbon and containing substantial amounts of sulfur as iron sulfide.

In the preferred application of gasifying high-sulfur coal, the materials fed to the jet-fluidized reactor will generally preferably comprise a high oxygen gas, such as commercial oxygen, oxygen-enriched air, or oxygen-steam mixtures, fed through the lance and a mixture of particulate solids (e.g. iron oxide, coal, etc.) fed into the side of the reactor. However, if desired, other liquid, solid or slurry feed streams may be added or returned to the reactor from subsequent processing steps. Likewise, a second gas stream may be introduced at low pressure if desired and this stream may be preferably added at a point where it will be entrained and mixed by the high velocity primary jets.

Jet-fluidized reactors utilizing jets directed generally downwardly need not be limited to the specific lance and vessel configurations shown in FIGS. 1 and 2. For example, reactor vessels of rectangular cross section have been used. Another variation with respect to a cylindrical vessel is to use two or more separate lances spaced evenly at angles of inclination to impart a controlled degree of angular rotation to the dynamically suspended fluid bed. Thus, when an oxygen lance is said to be disposed axially in the reactor, it includes either one or several lances disposed symmetrically in the reactor and above the bottom.

Figure 3:
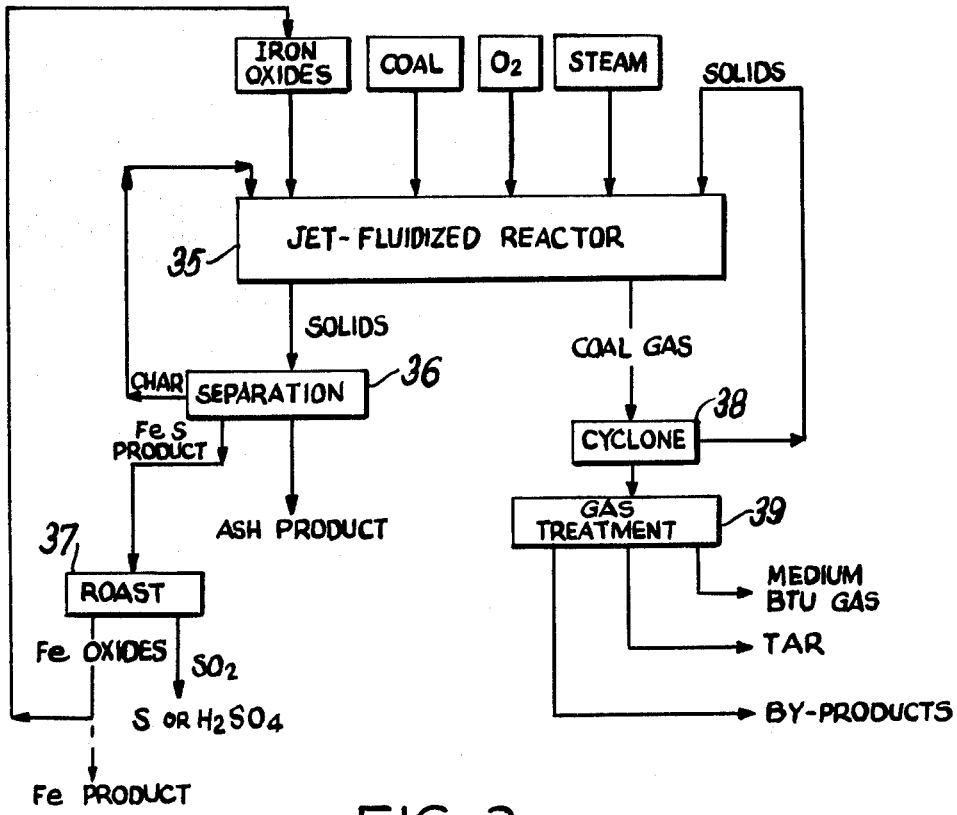
FIG. 3 is a flow sheet showing one embodiment of the method of the invention utilizing a jet-fluidized reactor in the treatment of high-sulfur coal in order to produce a "medium-BTU" gas and by-products comprising iron oxide and sulfur.
Figure 4:
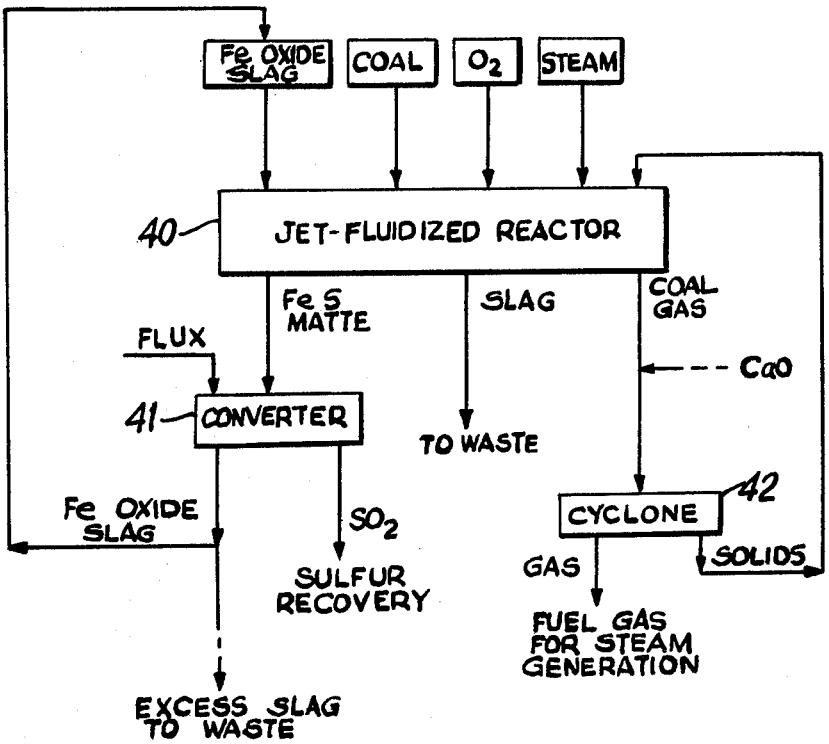
FIG. 4 is another flow sheet showing still another embodiment of the invention having particular use in the fasification of high-sulfur coal.

Several embodiments of the invention utilizing fluidization as an essential process component are illustrated in FIGS. 3 and 4. In these two embodiments, a mixture of commercial oxygen and steam is the primary reacting and fluidizing gas, and the fluidized bed under operating conditions involves coal, char or coke as a major constitutent. Tonnage oxygen is preferred to air or modestly enriched air to minimize compression costs, to secure higher reaction rates and throughputs, to conserve fuel and heat, and to reduce environmental problems. When all factors are considered, the use of oxygen generally will result in a net economic saving.

FIG. 3 is a flow sheet which illustrates one of the embodiments for treating high-sulfur crushed coal (e.g. bituminous) in which the ultimate products include a medium-BTU gas, coal-tar, sulfur in one form or another (that is, elemental or in the combined form) and other by-products.

Referring to FIG. 3, iron oxides, coal, steam and oxygen under pressure are fed to jet-fluidized reactor 35, the amount of iron oxides being in stoichiometric excess of that amount required to fix substantially all the sulfur present as iron sulfide as the process achieves a steady state basis. By steady state basis is meant that state which exists on a continuous basis where the iron oxides added continuously with the coal is correlated to assure fixing of the sulfur as an iron sulfide and produce a medium-BTU gas low in sulfur having a BTU content ranging from about 250 to 400 BTU per cubic foot of gas.

During the course of the continuous reaction, the fuel gas is continuously removed and the solid products, such as the iron sulfide, ash, and unreacted char are continuously removed from the furnace and subjected to separation by separator means 36, thus yielding an ash product, char to be returned to the reactor and an iron sulfide product. The iron sulfide is roasted at roaster means 37 (any well known metallurgical roasting furnace) to form iron oxides which are recycled to the reactor as required for sulfur fixation and $SO_2$ which may be used as a source material for the production of elemental sulfur or sulfuric acid. Depending on the particular reaction conditions, some sponge iron may also be produced as a by-product.

The effluent fuel gas is usually passed through a cyclone 38 or other separator means to remove entrained solids (carbonaceous solids and ash) which are recycled to the reactor. The gas leaving the cyclone is then subjected to gas treatment at means 39. If the product gas is to be burned directly in an adjacent boiler, gas treatment may be omitted. However, if a pipeline gas is to be produced, this treatment may include condensation and separation of tar and other by-products, and further upgrading by the shift reaction, methanation, and removal of residual sulfur compounds.

The jet-fluidized reactor serves primarily to gasify the coal and to fix the bulk of the sulfur as iron sulfide. The oxygen is largely consumed below the lance in very rapid exothermic reactions with the carbonaceous solids to produce both CO and $CO_2$, as follows:

$$2C + O_2 \rightarrow 2CO$$

$$C + O_2 \rightarrow CO_2$$

The heat generated from these reactions serves to heat up and pyrolize the incoming coal as well as to meet the thermal requirements of the two major endothermic gasification reactions $$CO_2 + C \rightarrow 2CO$$

$$H_2O + C \rightarrow CO + H_2$$

The $CO_2$-C and $H_2O$-C reactions are relatively slow and continue throughout the fluidized bed. Thus, to promote a high yield of CO and $H_2$ from these reactions, the fluidized bed must contain some excess of char and also must be at a sufficiently high temperature to provide adequate reaction rates. The CO and $H_2$ normally provide the bulk of the calorific value of low and medium BTU fuel gases. However, when carbonaceous solids containing substantial volatile matter (e.g., bituminous coals) are gasified, significant amounts of $CH_4$ and other hydrocarbons are evolved during pyrolysis, affording a significant increase in the calorific value of the product gas.

When iron oxide is fed to the gasification reactor for sulfur fixation, the following reaction occurs $$Fe_2O_3 + 2S + 3C \rightarrow 2FeS + 3CO$$

This reaction may occur partly or wholly in two steps:

(1) the reduction of iron oxide to sponge iron $$Fe_2O_3 + 3C \rightarrow 2Fe + 3CO$$

and (2) the reaction of sponge iron with sulfur $$Fe + S \rightarrow FeS$$

Following removal from the reactor, the FeS as well as the excess iron can be separated from the low-sulfur char by magnetic or gravity separation. An advantageous feature of the process is the cyclic use of iron oxide following roasting for sulfur recovery. Iron inherently present in the coal also serves as a sulfur fixer during the reaction.

FIG. 4 illustrates another embodiment for gasifying coal at above 2200° F to provide a clean gas rich in CO and $H_2$ for use in power generation. This process is similar to that illustrated in FIG. 3 in that iron is used for sulfur fixation. However, at temperatures above 2200° F, the sulfur-rich phase is molten (e.g. iron sulfide matte) with an overlying slag containing impurities from the coal (e.g. ash) and slag-forming additions, such as CaO. As will be apparent from FIG. 2, the slag and matte are removable through tap 29.

If the process is carried out on a sufficiently large scale, the rate of production of liquid matte might justify the use of a converter for converting the molten matte to $SO_2$ and an iron-rich slag. An alternative approach is to solidify the matte, crush it and roast it as shown in the flow sheet of FIG. 3.

Referring to FIG. 4, iron oxide slag from converter 41 is charged into jet-fluidized reactor 40 together with high-sulfur coal and possibly some CaO recycled as an additive to the coal gas fed into cyclone 42 and the mixture subjected to a jet of oxygen under pressure via an oxygen lance as illustrated in FIG. 2.

Iron sulfide matte is formed together with molten slag, the slag being separated from the matte and discharged to waste as shown. The matte while still in the molten condition and, in order to conserve heat, is charged together with a flux (e.g. silica or silica plus lime) into converter 41 where it is oxidized, either by bottom blowing or top blowing with oxygen or air to form $SO_2$ and an iron oxide slag for recycle to jet-fluidized reactor 40 as stated hereinabove. Any excess slag formed is bled off and discharged to waste. The $SO_2$ is sent to recovery either for recovery as liquid $SO_2$, elemental sulfur or as sulfuric acid, in the event a sulfuric acid plant is built as part of the system.

The effluent gas is passed throuh cyclone 42. Optionally, some CaO may be added as a supplemental desulfurizer which, together with entrained solids, is recycled to the reactor, the CaO reacting with sulfur present in the gas to form CaS which is also recycled. The clean gas emanating from the cyclone may then be used as fuel gas for steam generation. The calcium sulfide is partially oxidized in the reactor to form CaO which enters the slag and to release sulfur which is fixed by the iron, the balance of the CaS passing out with the slag.

The advantage of using iron to fix the bulk of the sulfur is that iron sulfide can be recycled, disposed of and handled more easily; whereas, as stated hereinbefore, calcium sulfide is not a desirable waste product nor can it be easily processed for sulfur recovery and CaO regeneration.

Another advantage of the foregoing process is that it can be carried out on a large scale using reactors ranging from about 10 feet to 20 feet in diameter and having a shaft height of about twice the diameter.

The rate of feed of oxygen under pressure is adjustable to provide average upward velocities on the rebound from the bottom of the reactor ranging from about 1 foot to 10 feet/sec. Velocities substantially above 10 ft/sec may cause considerable solids entrainment (particularly unburned coal) in the effluent gas which is counterproductive to the aims and objects of the invention.

Depending upon the size of the furnace, the particulate carbonaceous material may range in size up to about $\frac{3}{8}$ inch. Iron oxides for sulfur fixation will range preferably up to about 10 mesh (U.S. Standard). The rate of feed of oxygen through the lance and into the furnace to produce a dynamic swirling suspension of the type illustrated in FIGS. 1 and 2 is easily determined by experiment for a particular average particle size of feed coal.

The fuel gas obtained with the process of the invention may range in composition from about 40% to 90% by volume CO, up to about 10% $CO_2$, about 5% to 50% $H_2$, 0% to about 20% $CH_4$ and 0 to about 10% $H_2O$. The calorific values corresponding to the foregoing range of composition may range from about 150 to 500 BTU/ft$^3$ and generally from about 250 to 350 BTU/ft$^3$. If part of the oxygen is supplied by air, the fuel gas will of course contain substantial percentages of $N_2$ and the calorific value will be lower.

A wide variety of high-sulfur carbonaceous solid fuel can be treated in accordance with the invention. The high-sulfur bituminous coals of Illinois, Indiana, Iowa, Kansas, Kentucky and other states, are particularly adapted to gasification using the process of the invention.

As illustrative of the novel process of the invention, the following examples are given:

EXAMPLE 1

A typical high-sulfur Indiana coal having a heating value of about 12,900 BTU per pound and having an ultimate analysis by weight of about 72.2% C, 5.0% H, 1.6% N, 7.6% O, 2.8% S and 10.8% ash (dry basis) is gasified in accordance with the invention as follows:

A bench-scale jet-fluidized reactor is utilized in which a fireclay crucible 3 inches in diameter is employed to provide the bottom reaction chamber, the top wall of the crucible abutting coaxially against a cylindrical mullite tube about 1 foot in height, the tube-crucible assembly simulating a closed bottom shaft furnace. An oxygen lance is substantially centrally and axially extended through the mullite tube to just the top of the crucible with the nozzle end of the lance about 3½ inches from the bottom of the reaction chamber defined by the crucible, the lance being water-cooled. The lance is operated by feeding pressurized oxygen through a very small orifice (approximately 0.025 inch in diameter) drilled into the nozzle end of the lance. The crucible bottom of the jet-fluidized reactor assembly is supported in a vertically disposed electric furnace, which serves primarily to preheat an initial charge at startup. The reaction is started by first heating up a bed of coke to over 1800° F. Then oxygen is fed through the lance, the coke ignites immediately, and the high-sulfur bituminous coal (the aforementioned Indiana coal) is continuously fed into the crucible using a screw type feeder. After ignition occurs and a steady state of reaction is established with continuous feeding of $O_2$ and coal, the process becomes autogenous and the power supply to the electric furnace can be turned off. To assure complete fluidization in this laboratory-scale reactor, all solid feed materials are crushed to pass a 10 mesh screen (U.S. Standard).

The minus 10 mesh Indiana coal was gasified in the aforementioned laboratory jet-fluidized reactor in two successive tests for comparative purposes. Both tests were conducted at the same oxygen flow rate, about 5 liters per minute (STP). This flow rate was obtained by supplying oxygen to the lance at a pressure of about 20 psig, and was observed to provide good fluidization with little solids entrainment in the effluent gas. Under these conditions, the gas velocities in the reactor were estimated to range from a downward jet velocity of about 900 feet per second just below the nozzle to an average upward velocity of about 0.5 foot per second in the upper part of the mullite tube.

In the first of the two comparative tests, the coal was gasified at the rate of 6 grams per minute without slag formation and without addition of iron or other reagents for sulfur fixation. In the second test, slag forming constituents were added along with an excess of iron oxide to establish gasification under slagging conditions and to promote sulfur fixation as FeS. The feed to the second test accordingly comprised a mixture of 8.3 grams coal per minute and 1.7 grams of slag mixture per minute, the slag mixture having been made up in advance to correspond to an overall slag composition of 45% FeO, 20% CaO and 35% $SiO_2$.

Visual observations of the jet-fluidized beds were made by momentarily shutting off the feeding of solids. In both tests, the bottom chamber of the reactor (the crucible) under steady state conditions contained an incandescent, highly turbulent, jet-fluidized suspension moving downwardly under the lance, deflecting radially outward and then upwardly along the crucible walls and inwardly in a toroidally circulating manner as shown in FIGS. 1 and 2. This highly turbulent circulation and jet-fluidization was maintained in the second test as molten slag accumulated in the crucible. At the conclusion of the test, 60 grams of slag were recovered from the crucible.

During much of the testing period, the effluent gas leaving the top of the reactor burned with a visible flame. Chromatographic analyses of gas samples drawn from the upper part of the reactor gave about 10% $CO_2$ and about 45% CO.

Gas samples were taken systematically and analyzed for total sulfur by combustion with oxygen and iodimetric titration of the resulting $SO_2$. In the first test without addition of sulfur fixation agents, the sulfur content of the effluent gas ranged from 1.0 to 1.1% $H_2S$ by volume, showing that substantially all the sulfur content of the coal enters the product gas. In the second test, the sulfur content of the product gas averaged 0.56% $H_2S$, but reached levels of 0.29% $H_2S$ and 0.38% $H_2S$ during two sampling periods. It was observed that the sulfur content of the gas in the second test increased when the feeding of coal was interrupted momentarily, and this increase was attributed to partial oxidation of accumulated FeS to FeO and $SO_2$.

The accumulated slag in the second test was found to contain 0.4% S. In addition, a crude iron button weighing about 20 grams was found under the slag. This button contained 4% C and 4% S, and thus accounted for a substantial portion of the S from the original coal. In addition, the formation of a metallic button shows that the chemically reducing conditions associated with effective coal gasification and sulfur fixation as FeS are readily attained in the jet-fluidized reactor even in the portion of the reactor under the oxygen lance.

EXAMPLE 2

A jet-fluidized reactor, 20 feet inside diameter and 50 feet high and with the operating features shown in FIG. 2 is designed to gasify and desulfurize 1200 tons per day (50 tons per hour) of a midwestern bituminous coal. The hot product gas following reaction is passed directly to a high-temperature cyclone separator which returns entrained solids to the gasification reactor. The gas leaving the cyclone passes directly to the combustion chamber of a boiler where it is burned with air to generate the steam for a 100 megawatt steam turbine.

The composition of the incoming coal in percent by weight is given in Table 1 as follows:

Table 1

| Composition of a Midwestern Bituminous Coal | | | | | | | |
|---|---|---|---|---|---|---|---|
| $H_2O$ | C | H | S | O | N | Ash | Total |
| 7.5 | 67.0 | 5.0 | 3.3 | 6.3 | 1.4 | 9.5 | 100.0 |

Before entering the gasification reactor, the coal is crushed to minus ¼ inch, dried, and heated to about 600° F in an oxidizing atmosphere to destroy its caking tendency. For sulfur fixation, 120 tons per day (5 tons per hour) of high-iron roaster calcine are also fed to the gasification reactor. This calcine contains 65% Fe, largely as $Fe_2O_3$, and is a coal by-product returned from the sulfur and iron recovery circuit.

The gas fed to the reactor through the centrally disposed vertical lance is a mixture of oxygen and steam, comprising 0.62 pound $O_2$ and 0.32 pound $H_2O$ per pound of incoming raw coal, corresponding to approximately 11,500 cubic feet per minute (STP) of $O_2$ and approximately 11,000 cubic feet per minute (STP) of $H_2O$. The lance is supplied with the gas mixture at a gage pressure of 100 pounds per square inch and at 600° F. The gas enters the fluidized bed through three convergent-divergent nozzles, each discharging downward at an angle of 15° with the certical axis of the lance and discharging radially outward at 120° intervals around the axis of the lance. The lance is positioned so that the nozzles discharge 20 feet above the inside bottom surface of the reactor.

The region of the reactor below the lance is characterized by high flow velocities, rapid toroidal circulation of the fluidized mixture, rapid reaction rates, and temperatures reaching 2400° to 2600° F near the bottom of the vessel. Under these conditions, a molten bath from 2 to 3 feet in depth is established in the bottom of the reactor vessel, consisting of a bottom layer of Fe-S matte and a top layer of molten slag formed from the coal ash. The slag layer is substantially penetrated by the high velocity jet of fluidized char and accompanying gases. The Fe-S product and the slag are tapped semi-continuously to maintain the total bath depth within a range of smooth operation and always sufficiently deep to protect the bottom of the reactor. The slag product amounts to about 120 tons per day. The Fe-S matte, about 140 tons per day, assays 67% Fe, 30% S, and 1% C. It is sent to the sulfur and iron recovery circuit.

The tail gas from the sulfur recovery circuit, amounting to about 1200 cubic feet per minute, is returned to the fluidized-bed reactor through an auxiliary tuyere, to minimize overall emission of sulfur compounds into the atmosphere.

Above the level of the oxygen-steam inlet nozzles in the jet-fluidized reactor, the principal reactions are the $H_2O$-C and $CO_2$-C gasification reactions, the reduction of $Fe_2O_3$ and the formation of FeS, and the pyrolysis of the incoming coal. These reactions are largely endothermic, so that the reactor temperature decreases substantially from bottom to top and the gases leaving the reactor are at a temperature of about 1500° to 1700° F.

The fuel gas is produced at the rate of 54,000 cubic feet per minute (STP) and will generally have the analysis given in Table 2, the net calorific power of this gas being about 306 BTU per cubic foot (STP).

Table 2

| Composition of Fuel Gas Percent by Volume | | | | | |
|---|---|---|---|---|---|
| $H_2$ | $CH_4$ | CO | $CO_2$ | $H_2O$ | $H_2S$ |
| 35.5 | 4.35 | 47.5 | 9.5 | 3.0 | 0.15 |

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A process for promoting gasification reaction between an oxygen-rich gas and particulate carbonaceous solids to produce a combustible effluent gas and a residue which comprises, continuously feeding particulate carbonaceous fuel solids to a closed bottom jet-fluidized reactor, said reactor having a roof enclosure, directing an oxygen-rich gaseous jet stream into said reactor by means of a lance passing axially through said roof enclosure to fluidize said carbonaceous solids and to effect gasification reactions, said oxygen-rich gas and said particulate carbonaceous solids being fed to the reactor at rates proportioned to effect exothermic reaction and provide reactor temperatures of at least about 1600° F, discharging said gaseous jet stream into said reactor at a nozzle velocity sufficient to form a highly turbulent and rapidly circulating suspension of particulate solids deflecting substantially radially outwardly on the bottom, upwardly on the outside and then inwardly and downwardly below the jet, said circulating suspension defining a reaction zone adjacent to the bottom of said reactor, maintaining total feed rates of said oxygen-rich gas and carbonaceous solids to provide an average upward velocity of effluent gas substantially above the minimum fluidization velocity for said particulate solids, and removing said effluent gas and residue formed by said gasification from said reactor.

2. The process of claim 1, wherein said particulate carbonaceous solids are partially gasified to form said combustible gas and a residue comprising char and ash.

3. The process of claim 1, wherein said particulate carbonaceous solids are substantially completely gasified to form said combustible gas and a residue comprising ash.

4. The process of claim 1, wherein said gasification is carried out in the presence of steam continuously fed to said reactor in an amount sufficient to provide an endothermic production of hydrogen by reaction with carbonaceous solids in said reactor.

5. The process of claim 3, wherein slag-forming constituents are fed to the reactor with said carbonaceous solids to form a liquid slag with said ash, wherein a layer of liquid slag is maintained at the bottom of said reactor, and wherein said jet-fluidized reaction is further augmented at the gas-liquid interface of said slag, any excess slag formed being withdrawn from said reactor.

6. The process of claim 3, wherein solids entrained in said effluent gas are separated therefrom and returned to the reactor.

7. The process of claim 3, wherein the particulate carbonaceous solids is high-sulfur coal, and wherein the particulate coal fed to the reactor is blended with an amount of a solid particulate sulfur combining material at least stoichiometrically sufficient to fix said sulfur and to remove it from the combustible effluent gas.

8. A process for promoting gasification reaction between an oxygen-rich gas and particulate carbonaceous coal to produce a combustible effluent gas and a residue which comprises, continuously feeding particulate coal and slag-forming constitutents to a closed bottom jet-fluidized reactor, said reactor having a roof enclosure, directing an oxygen-rich gaseous jet stream into said reactor by means of a lance passing axially through said roof enclosure to fluidize said coal and to effect gasification reactions and form an ash-containing residue, said oxygen-rich gas and particulate coal being fed to the reactor at rates proportioned to effect exothermic reaction and provide reactor temperatures of about 1800° to 2700° F, discharging said gaseous jet stream into said reactor at a nozzle velocity sufficient to form a highly turbulent and rapidly circulating suspension of particulate solids deflecting substantially radially outwardly on the bottom, upwardly on the outside and then inwardly and downwardly below the jet, said circulating suspension defining a reaction zone adjacent to the bottom of said reactor, maintaining total feed rates of said oxygen-rich gas and said particulate coal to provide an average upward velocity of effluent gas substantially above the minimum fluidization velocity for said particulate coal, forming a molten slag layer at the bottom of said reactor with said slag-forming constituents and ash as it forms, and removing said combustible effluent gas and excess slag from said reactor while maintaining said slag layer during said gasification reaction.

9. The process of claim 8, wherein said particulate coal is partially gasified to form a residue containing char in addition to said ash, said ash being removed in the slag, and said char being recycled to said reactor.

10. The process of claim 8, wherein said particulate coal is substantially completely gasified to form said combustible gas, the ash residue being removed from the zone of reaction by slagging with said slag-forming constitutents.

11. The process of claim 10, wherein said gasification reaction is carried out in the presence of steam continuously fed to said reactor in an amount sufficient to provide an endothermic production of combustible gas comprising hydrogen by reaction with said particulate coal in said reactor.

12. The process of claim 8, wherein said coal is a high-sulfur coal, and wherein the particulate coal fed to the reactor is blended with an amount of particulate iron-containing sulfur-fixing material selected from the group consisting of metallic iron and iron oxide at least stoichiometrically sufficient to form a molten iron-containing layer disposed below said slag layer and containing a substantial amount of said sulfur.

13. A continuous process for converting particulate high-sulfur coal by gasification into a low-sulfur combustible effluent gas and a residue which comprises, continuously feeding particulate high-sulfur coal and slag-forming constitutents to a closed bottom jet-fluidized reactor together with particulate sulfur-fixing material selected from the group consisting of metallic iron and iron oxide, said reactor having a roof enclosure, directing an oxygen-rich gaseous jet stream into said reactor by means of a lance passing axially through said roof enclosure to fluidize said particulate coal and form a low-sulfur combustible gas and an ash-containing residue, said oxygen-rich gas and said particulate coal being fed to the reactor at rates proportioned to effect exothermic reaction and provide reactor temperatures ranging from about 1800° to 2700° F, discharging said gaseous jet stream into said reactor at a nozzle velocity sufficient to form a highly turbulent and rapidly circulating suspension of particulate solids deflecting substantially radially outwardly on the bottom and upwardly on the outside and then inwardly and downwardly below the jet, said circulating suspension defining a reaction zone adjacent to the bottom of said reactor, maintaining total feed rates of said oxygen-rich gas and said particulate coal to provide an average upward velocity of effluent gas substantially above the minimum fluidization velocity for said particulate coal, continuing said gasification to form a first molten layer of slag at the bottom of said reactor with said slag-forming constituents and the ash as it forms and a second molten layer below said slag layer comprising iron and containing sulfur fixed as iron sulfide, and removing said combustible effluent gas, excess slag and excess iron-containing layer from said reactor while maintaining a slag layer during said gasification reaction.

14. The process of claim 13, wherein said particulate coal is partially gasified to form a residue-containing char in addition to said ash, said ash being removed in the slag, and said char being recycled to said reactor.

15. The process of claim 13, wherein said particulate coal is substantially completely gasified to form a medium BTU combustible gas.

16. The process of claim 13, wherein said gasification reaction is carried out in the presence of steam continuously fed to said reactor in an amount sufficient to provide an endothermic production of combustible gas comprising hydrogen by reaction with said particulate coal in said reactor.

* * * * *